US005992051A

United States Patent [19]

Salehibakhsh

[11] Patent Number: 5,992,051

[45] Date of Patent: Nov. 30, 1999

[54] CARPET DRYING SYSTEM

[76] Inventor: Peyman Salehibakhsh, 10587 Holman, Los Angeles, Calif. 90024

[21] Appl. No.: 09/121,324

[22] Filed: Jul. 23, 1998

[51] Int. Cl.[6] ..... F26B 9/00; F26B 13/00; F26B 13/06

[52] U.S. Cl. ..... 34/638; 34/618; 34/633; 34/636; 15/309.1

[58] Field of Search ..... 34/618, 624, 633, 34/636, 638, 646, 444, 448, 273, 274, 237, 81, 87; 15/309.1, 308

[56] References Cited

U.S. PATENT DOCUMENTS 3,286,368 11/1966 Thomas ..... 34/618
3,774,262 11/1973 Anthony et al. ..... 15/322
4,145,821 3/1979 Schantz ..... 34/237
5,208,940 5/1993 London et al. ..... 15/345
5,548,905 8/1996 Kuma et al. ..... 34/92
5,797,197 8/1998 Alday ..... 34/618

*Primary Examiner*—Henry Bennett
*Assistant Examiner*—Pamela A. Wilson

[57] ABSTRACT

A carpet drying system is provided including at least one housing and a plurality of air ports mounted on a bottom of the housing for being inserted within a carpet. Also included is an air compressor connected to the housing and in fluidic communication with the air ports for directing air therethrough, thereby aerating the carpet.

14 Claims, 2 Drawing Sheets

CARPET DRYING SYSTEM

BACKGROUND OF THE INVENTION

1. Field of the Invention

The present invention relates to carpet cleaners and more particularly pertains to a new carpet drying system for drying a carpet in an expeditious manner by way of aeration.

2. Description of the Prior Art

The use of carpet cleaners is known in the prior art. More specifically, carpet cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art carpet cleaners and the like include U.S. Pat. No. 4,329,756; U.S. Pat. No. 5,287,591; U.S. Pat. No. 4,531,257; U.S. Pat. No. 4,447,930; U.S. Pat. No. 4,216,563; and U.S. Pat. No. Des. 288,738.

In these respects, the carpet drying system according to the present invention substantially departs from the conventional concepts and designs of the prior art, and in so doing provides an apparatus primarily developed for the purpose of drying a carpet in an expeditious manner by way of aeration.

SUMMARY OF THE INVENTION

In view of the foregoing disadvantages inherent in the known types of carpet cleaners now present in the prior art, the present invention provides a new carpet drying system construction wherein the same can be utilized for drying a carpet in an expeditious manner by way of aeration.

The general purpose of the present invention, which will be described subsequently in greater detail, is to provide a new carpet drying system apparatus and method which has many of the advantages of the carpet cleaners mentioned heretofore and many novel features that result in a new carpet drying system which is not anticipated, rendered obvious, suggested, or even implied by any of the prior art carpet cleaners, either alone or in any combination thereof.

To attain this, the present invention generally comprises a plurality of differently sized housings. Preferably, the housings generally form blocks, each having a rectilinear configuration. Each block is defined by a planar top face, a planar bottom face and a peripheral wall formed therebetween thus defining an interior space. As shown FIG. 2, the top face of each block has an L-shaped conduit. Such L-shaped conduit has a lower vertical extent rotatably coupled to the associated block and in fluidic communication therewith. Next provided is a matrix of needles each having an open top of a first diameter. Such open top of each of the needles is mounted to the bottom face of each of the blocks and in fluidic communication with the interior space thereof. As shown in FIG. 3, each needle has an open bottom of a second diameter less than the first diameter. It should be noted that each needle has a tapering side wall. In use, the open bottom of each needle is tailored for being inserted within a carpet. As shown in FIGS. 2 & 3, a plurality of disk-shaped female slots are formed in a first pair of adjacent side faces of the peripheral wall of each block. Associated therewith is a plurality of disk-shaped male protrusions formed in a second pair of adjacent side faces of the peripheral side wall of each block. By this structure, the blocks may be interconnected in coplanar relationship, as shown in FIG. 1. FIG. 1 shows a wheeled air compressor for generating compressed air at an output pipe thereof. Also depicted is a connector assembly including a rigid, linear interconnect pipe. The interconnect pipe is equipped with a first side face with a plurality of linearly aligned and equally spaced output apertures formed therein. A second side face of the interconnect pipe has an input aperture formed on an end thereof for being releasably connected to the output pipe of the air compressor. With reference still to FIG. 1, the connector assembly further has a plurality of flexible conduits each has a first end connected to one of the output apertures of the interconnect pipe. A second end of each flexible conduit is releasably connected to the upper horizontal extent of the L-shaped conduit of one of the blocks for dispensing air through the needles thereof. As such, the carpet is aerated and dried in an expeditious manner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new carpet drying system apparatus and method which has many of the advantages of the carpet cleaners mentioned heretofore and many novel features that result in a new carpet drying system which is not anticipated, rendered obvious, suggested, or even implied by any of the prior art carpet cleaners, either alone or in any combination thereof.

It is another object of the present invention to provide a new carpet drying system which may be easily and efficiently manufactured and marketed.

It is a further object of the present invention to provide a new carpet drying system which is of a durable and reliable construction.

An even further object of the present invention is to provide a new carpet drying system which is susceptible of a low cost of manufacture with regard to both materials and labor, and which accordingly is then susceptible of low prices of sale to the consuming public, thereby making such carpet drying system economically available to the buying public.

Still yet another object of the present invention is to provide a new carpet drying system which provides in the apparatuses and methods of the prior art some of the advantages thereof, while simultaneously overcoming some of the disadvantages normally associated therewith.

Still another object of the present invention is to provide a new carpet drying system for drying a carpet in an expeditious manner by way of aeration.

Even still another object of the present invention is to provide a new carpet drying system that includes at least one housing and a plurality of air ports mounted on a bottom of the housing for being inserted within a carpet. Also included is an air compressor connected to the housing and in fluidic communication with the air ports for directing air therethrough, thereby aerating the carpet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
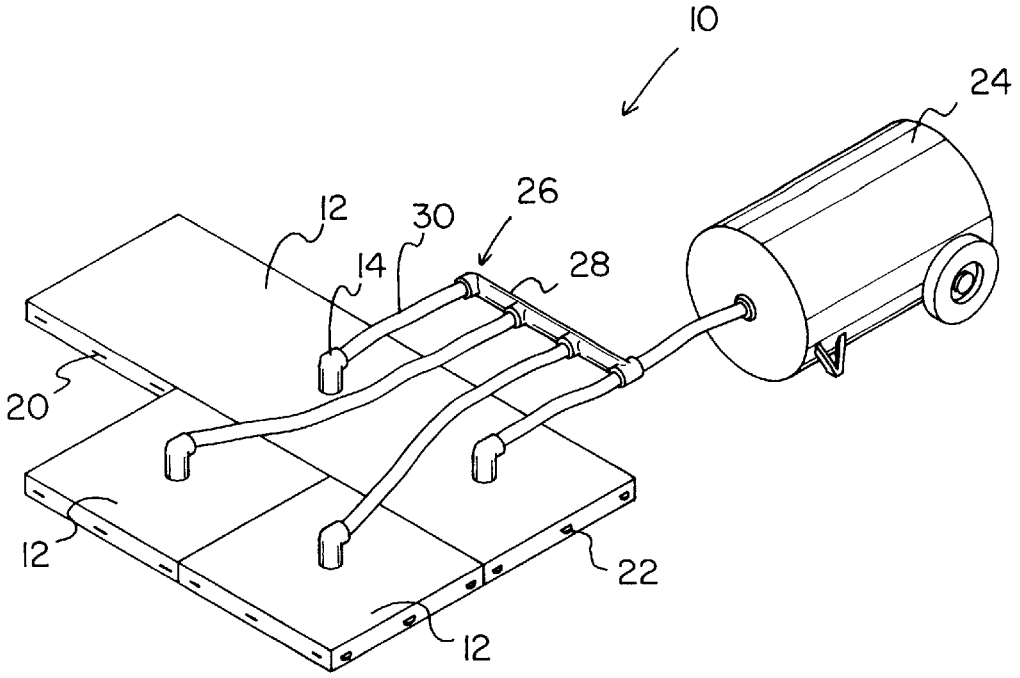
FIG. 1 is a perspective view of a new carpet drying system according to the present invention.

With reference now to the drawings, and in particular to FIGS. 1 through 4 thereof, a new carpet drying system embodying the principles and concepts of the present invention and generally designated by the reference numeral 10 will be described.

The present invention, designated as numeral 10, includes a plurality of differently sized housings 12 each having a rectilinear configuration. Each housing forms a block which is defined by a planar top face, a planar bottom face and a peripheral wall formed therebetween thus defining an interior space. The blocks each preferably have lengths and widths which are even multiples of that of the remaining blocks. Further, the blocks are preferably constructed from a heavy metal for reasons that will become apparent hereinafter.

Figure 2:
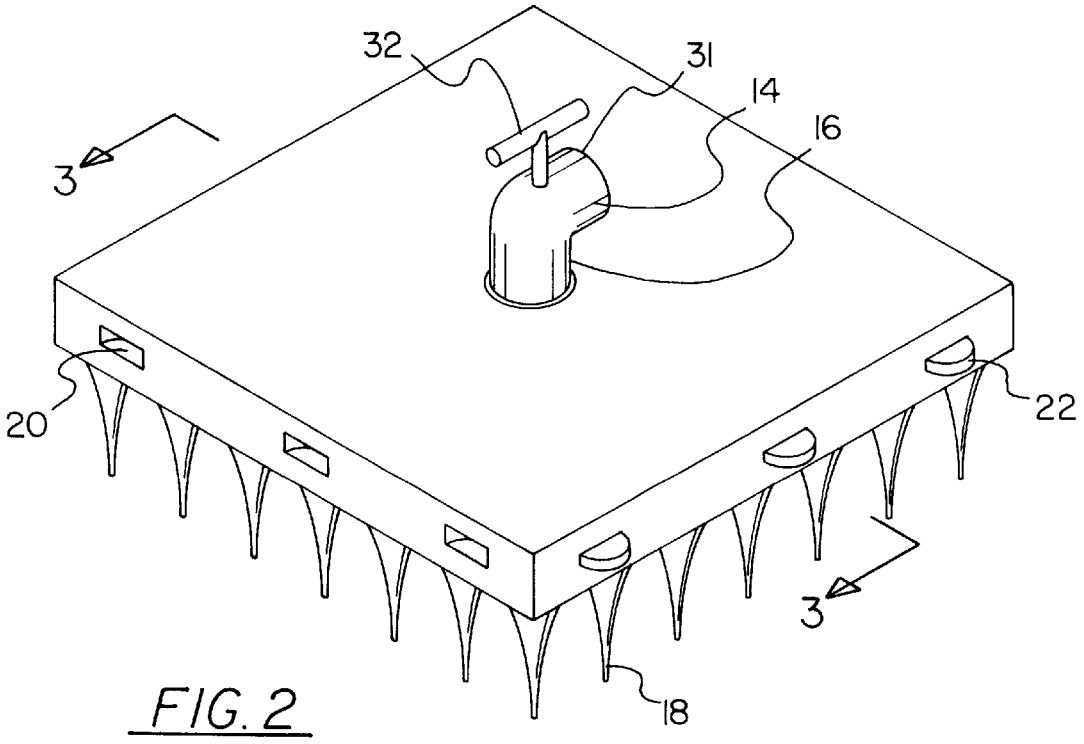
FIG. 2 is a detailed perspective view of one of the blocks of the present invention.

As shown FIG. 2, the top face of each block has an L-shaped conduit 14 mounted on a central extent thereof. Such L-shaped conduit has a lower vertical extent 16 rotatably coupled to the associated block and in fluidic communication therewith. It should be noted that on some blocks, two conduits may be mounted thereon in a staggered fashion.

Figure 3:
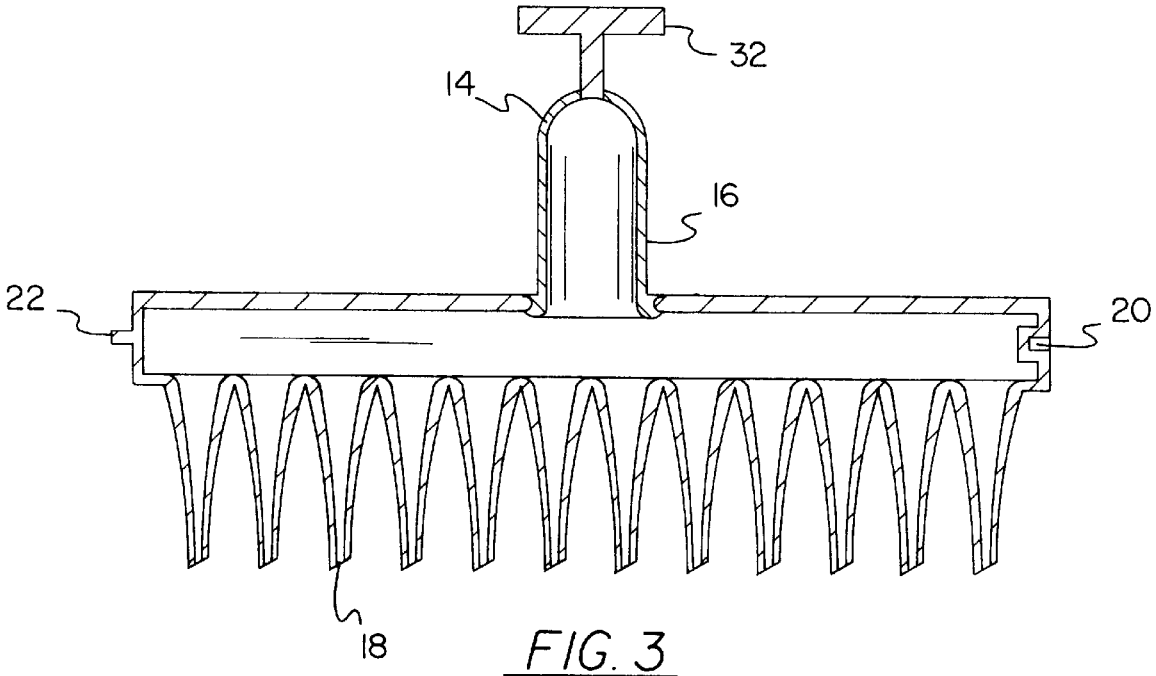
FIG. 3 is a side cross-sectional view of the present invention taken along line 3—3 shown in FIG. 2.
Figure 4:
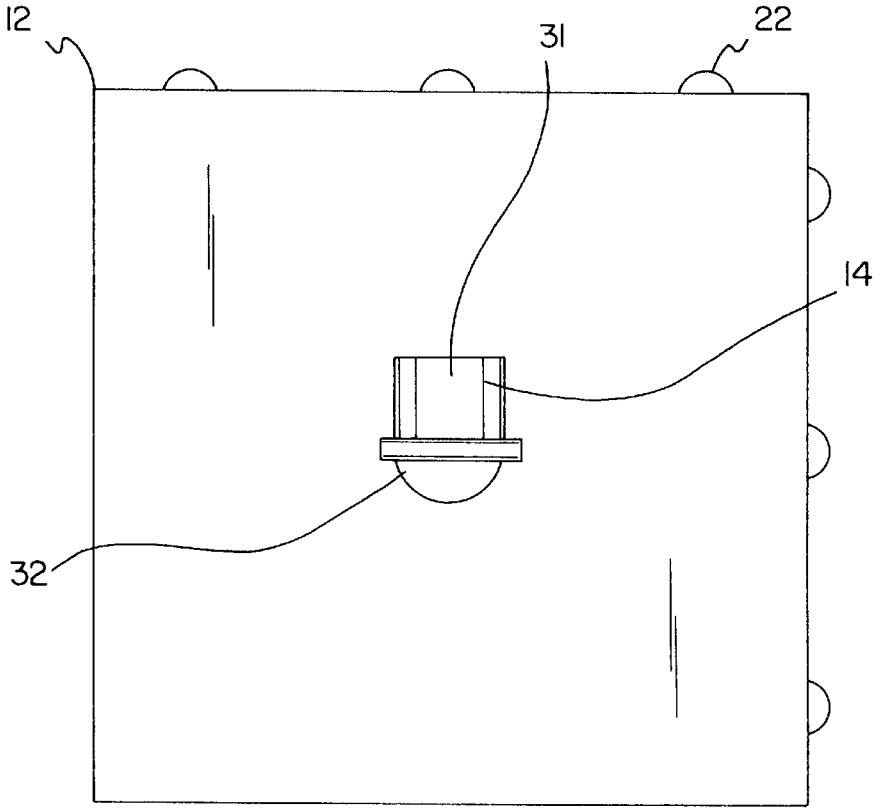
FIG. 4 is a top view of the present invention.

Next provided is a matrix of vertically oriented needles 18 each having an open top of a first diameter. Such open top of each of the needles is mounted to the bottom face of each of the blocks and in fluidic communication with the interior space thereof. As shown in FIG. 3, each needle has an open bottom of a second diameter less than the first diameter. It should be noted that each needle has a tapering side wall and the bottom end thereof is beveled. The open bottom end of each needle is thus tailored for being inserted within a carpet and abutted against a recipient surface therebelow.

As shown in FIGS. 2 & 3, a plurality of disk-shaped female slots 20 are formed in a first pair of adjacent side faces of the peripheral wall of each block. Associated therewith is a plurality of disk-shaped male protrusions 22 formed in a second pair of adjacent side faces of the peripheral side wall of each block. By this structure, the blocks may be interconnected in coplanar relationship, as shown in FIG. 1.

FIG. 1 further shows a wheeled air compressor 24 for generating compressed air at an output pipe thereof. As an option, multiple air compressors may be employed. Also depicted is a connector assembly 26 including a rigid, linear interconnect pipe 28. The interconnect pipe is equipped with a first side face with a plurality of linearly aligned and equally spaced output apertures formed therein. A second side face of the interconnect pipe has an input aperture formed on an end thereof for being releasably connected to the output pipe of the air compressor.

With reference still to FIG. 1, the connector assembly further has a plurality of flexible conduits 30 each has a first end connected to one of the output apertures of the interconnect pipe. A second end of each flexible conduit is releasably connected to the upper horizontal extent 31 of the L-shaped conduit of one of the blocks for dispensing air through the needles thereof. As such, the carpet is aerated and dried in an expeditious manner. As an option, each of the L-shaped conduits may be equipped with a manually adjustable regulator 32 for allowing a user to determine how much air is injected through the needles of each of the blocks. This affords certain portions of a carpet additional aeration with respect to the remaining portions. While not shown, it should be noted that the regulator has structure similar to that used in the art of bathroom faucets.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carpet drying system comprising, in combination:

a plurality of differently sized blocks each having a rectilinear configuration and defined by a planar top face, a planar bottom face and a peripheral wall formed therebetween thus defining an interior space, the top face of each block having an L-shaped conduit with an upper horizontal extent and a lower vertical extent rotatably coupled thereto and in fluidic communication therewith;

a matrix of needles each having an open top of a first diameter mounted to the bottom face of each of the blocks and in fluidic communication with the interior space thereof, each needle having an open bottom of a second diameter less than the first diameter for being inserted within a carpet, wherein each needle has a tapering side wall;

a plurality of disk-shaped female slots formed in a first pair of adjacent side faces of the peripheral wall of each block and a plurality of disk-shaped male protrusions formed in a second pair of adjacent side faces of the peripheral side wall of each block, wherein the blocks may be interconnected in coplanar relationship;

a wheeled air compressor for generating compressed air at an output pipe thereof; and a connector assembly including a rigid, linear interconnect pipe with a first side face with a plurality of linearly aligned and equally spaced output apertures formed therein and a second side face with an input aperture formed on an end thereof for being releasably connected to the output pipe of the air compressor, the connector assembly further including a plurality of flexible conduits each having a first end connected to one of the output apertures of the interconnect pipe and a second end releasably connected to the upper horizontal extent of the L-shaped conduit of one of the blocks for dispensing air through the needles thereof, thereby aerating the carpet.

2. A carpet drying system comprising:

at least one housing;

a plurality of air ports mounted on a bottom of the housing for being inserted within a carpet;

an air compressor connected to the housing and in fluidic communication with the air ports for directing air therethrough, thereby aerating the carpet.

3. A carpet drying system as set forth in claim 2 wherein a plurality of housings are included and each takes the form of a planar block.

4. A carpet drying system as set forth in claim 3 and further including a connector assembly for connecting the air compressor to each of the housings.

5. A carpet drying system as set forth in claim 3 wherein the plurality of housings are interconnectable.

6. A carpet drying system as set forth in claim 2 wherein a regulator is mounted on the housing for selectively determining an amount of air flowing through the air ports thereof.

7. A carpet drying system as set forth in claim 2 wherein the air ports include a plurality of needles.

8. A carpet drying system as set forth in claim 2 wherein the air compressor is connected to the housing via a rotatable connection.

9. A carpet drying system comprising:

at least one housing;

a plurality of air ports mounted on a bottom of the housing wherein the air ports include a plurality of needles for being inserted within a carpet;

an air compressor connected to the housing and in fluidic communication with the air ports for directing air therethrough, thereby aerating the carpet.

10. A carpet drying system as set forth in claim 9 wherein a plurality of housings are included and each takes the form of a planar block.

11. A carpet drying system as set forth in claim 10 and further including a connector assembly for connecting the air compressor to each of the housings.

12. A carpet drying system as set forth in claim 10 wherein the plurality of housings are interconnectable.

13. A carpet drying system as set forth in claim 9 wherein a regulator is mounted on the housing for selectively determining an amount of air flowing through the air ports thereof.

14. A carpet drying system as set forth in claim 9 wherein the air compressor is connected to the housing via a rotatable connection.

* * * * *